United States Patent [19]

Reeser et al.

[11] Patent Number: 4,597,345

[45] Date of Patent: Jul. 1, 1986

[54] TORPEDO CABLELESS UMBILICAL

[75] Inventors: Floyd H. Reeser, Centre Hall; Francis G. Quinn, State College, both of Pa.

[73] Assignee: The United States of America as represented by the Secretary of the Navy, Washington, D.C.

[21] Appl. No.: 665,586

[22] Filed: Oct. 29, 1984

[51] Int. Cl.[4] ..... F42B 19/00

[52] U.S. Cl. ..... 114/20 R; 89/1.809

[58] Field of Search ..... 89/1.809, 1.810, 6.5; 114/20 R, 21 R, 316

[56] References Cited

U.S. PATENT DOCUMENTS

| | | | |
|---|---|---|---|
| 3,167,047 | 1/1965 | Eng | 114/20 R |
| 3,756,181 | 9/1973 | Beach | 114/20 R |
| 4,091,734 | 5/1978 | Redmond et al. | 89/6.5 |
| 4,318,342 | 3/1982 | Chandler | 89/6.5 |

*Primary Examiner*—Charles T. Jordan

*Attorney, Agent, or Firm*—Robert F. Beers; Arthur A. McGill; Michael J. McGowan

[57] ABSTRACT

A communications link between a submarine and a torpedo secured within a launch tube flooded with seawater. A transmit/receive light beam pair propagating through the water provides the high bandwidth data channels between the tube wall and the adjacent torpedo hull for two-way communication.

3 Claims, 2 Drawing Figures

TORPEDO CABLELESS UMBILICAL

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a signal transmission system between a fire control and a torpedo loaded within a torpedo tube and more particularly to a cableless communications link employing collinear optical fibers embedded in the torpedo tube wall and the torpedo hull for providing at least one pair of high bandwidth transmit/receive channels for two-way communications.

(2) Description of the Prior Art

It is well known that at present communications between a submarine fire control system and torpedoes loaded within the submarine torpedo tubes are carried out over umbilical cables linking the two. Such a physical link has several disadvantages however. For example, tube and torpedo hull penetrations must exhibit high pressure integrity. In addition, a breakaway type launch is required when using a cable. A two-part connector must be used in conjunction with the cable. One part of the connector and the cable are left in the tube after launch. Only the part of the connector flush with the hull exits with the torpedo. Seal reliability is often not high. Further, the data transfer rate is relatively low. Also the cable must be carried with the torpedo.

SUMMARY OF THE INVENTION

Accordingly, it is a general purpose and object of the present invention to provide a high bandwidth data link between a loaded torpedo and a submarine fire control system. It is a further object that such link require no physical cable connection between the ship and torpedo. Another object is that such system not be overly sensitive to torpedo-to-tube longitudinal alignment while loaded in the tube. A still further object is that torpedo tube and hull penetrations be small to permit a pressure seal.

These objects are accomplished with the present invention by providing an optical fiber, high bandwidth, two-way umbilical less communication link between a ship fire control system and a torpedo guidance and control system comprising at least one transmit channel/return channel pair, each channel having a light source which receives a modulated first electrical signal and produces a proportionally modulated light beam. The beam is transmitted via a first optical fiber through a pressure wall and permitted to propagate across a short seawater path where it illuminates a second optical fiber end embedded in a second pressure wall the first fiber having a numerical aperture selected so as to accommodate any torpedo to tube misalignment. From there it is transmitted by the second fiber to a photosensitive receiver which converts the light beam back to an electrical signal corresponding to the first electrical signal.

A more complete understanding of the invention and many of the attendant advantages thereto will be readily appreciated as the same becomes better understood by reference to the following detailed description when considered in conjunction with the sole accompanying drawing wherein:

DESCRIPTION OF THE PREFERRED EMBODIMENT

Figure 1:
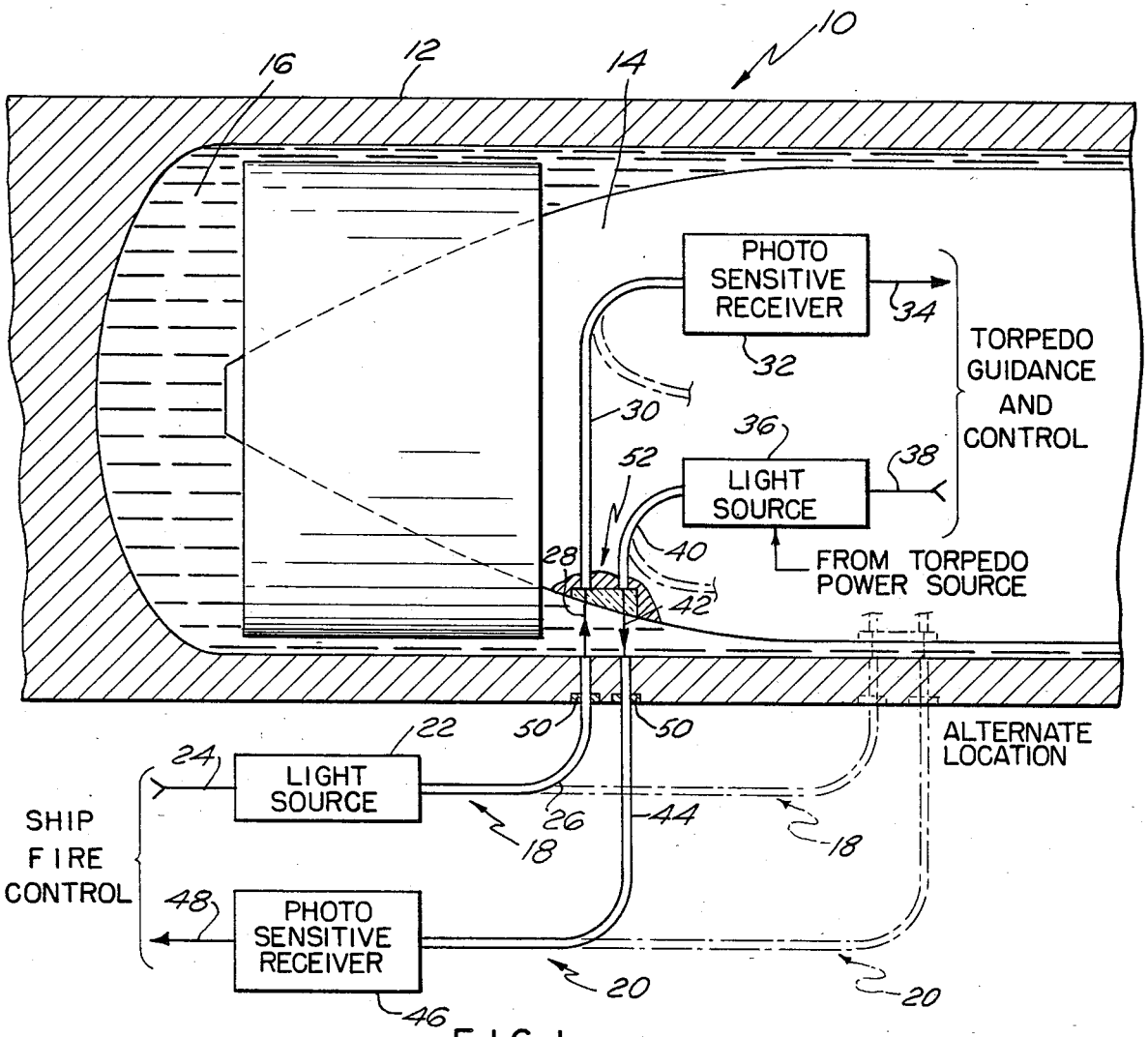
FIG. 1 shows a data link system according to the teachings of the present invention.

Referring now to FIG. 1 there is shown a communication link system 10 for providing at least one high bandwidth transmit/receive channel pair between a torpedo tube 12 installed in a submarine hull and a torpedo 14 loaded within tube 12. Torpedo 14, having a diameter smaller than tube 12, is positioned and held in a preselected positional relationship with respect to tube 12 while the remaining cavity therebetween is flooded by seawater 16. Each transmit/receive communication channel pair comprises a transmit channel generally identified as 18 and a receive channel generally identified as 20. Transmit channel 18 further comprises a light source 22 located external to tube 12 which receives modulated electrical signals via a cable 24 from ships fire control producing a light beam modulated in proportion thereto. The light beam is transmitted via a first optical fiber 26 to and through the wall of tube 12. Fiber 26 passes through the tube wall and attaches to the wall in a pressure tight manner while being oriented such that the light beam traveling therein exits the fiber end as beam 28 propagating orthogonal to the longitudinal axis of tube 12 through seawater 16. Beam 28 propagates across the relatively small, water filled gap between tube 12 and the hull of torpedo 14 where it illuminates one end of a second optical fiber 30 positioned generally coaxial with fiber 26. Fiber 30 transmits the received portion of light beam 28 to photosensitive receiver 32 housed within torpedo 14 to which the other end thereof is attached. Photosensitive receiver 32 converts beam 28 back to a proportional electrical signal which is then transmitted via cable 34 t the guidance and control system of torpedo 14. Receive channel 20 further comprises a light source 36 located onboard torpedo 14 and powered by the torpedo power source. Light source 36 receives electrical signals via cable 38 from the torpedo guidance and control system and produces therefrom a light beam modulated in proportion thereto. The light beam is transmitted via a third optical fiber 40 which passes through the torpedo hull, attaching to the hull in a water tight fashion while being oriented such that the light beam traveling therein exits the fiber end as beam 42 traveling orthogonal to the longitudinal axis of torpedo 14 through seawater 16. Beam 42 propagates across the relatively small seawater filled gap between the hull of torpedo 14 and torpedo tube 12 where it illuminates one end of a fourth optical fiber 44 positioned generally coaxial with fiber 40. Fiber 44 transmits the received portion of light beam 42 to photosensitive receiver 46 housed aboard ship to which the other end thereof attaches. Photosensitive receiver 46 converts beam 42 back to a proportional electrical signal which is then transmitted via cable 48 to the ship's fire control system.

In order to maintain pressure integrity for the submarine, hull penetrators 50 are used to sealably attach fibers 26 and 44 to tube 12. Penetrators 50 may be selected from any of the commercially available penetrators. A transparent window 52, sealably embedded in the hull of torpedo 14, is shaped so as to be flush with the torpedo's outer surface while abutting the ends of fibers 30 and 40. The shape of optically transparent window 52 will vary depending on the choice of location of fibers 30 and 40 on either the cylindrical or tapered section of the torpedo body.

Figure 2:
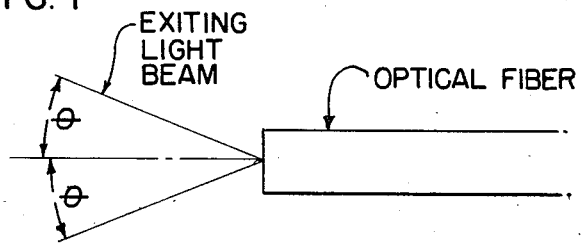
FIG. 2 shows a typical optical fiber Numerical Aperture.

Channels 18 and 20 are high bandwidth channels, require no physical link between the torpedo hull and the torpedo tube and provide for two-way high speed communications. A coherent or incoherent light source can easily transmit data across the few inches of water separating the torpedo and tube wall. The axial alignment of the fiber ends is not critical because the Numerical Aperture (NA) of the fiber, as shown in FIG. 2, allows for the normal torpedo placement errors. Numerical Aperture $=\sin\theta$ and it is not unusual to have an NA of 0.4 which corresponds to $\theta$ of 22 degrees. It is also noted that while the water gap dimension between the torpedo and the tube wall is not crucial to operation of this invention, the light source power requirements will vary, e.g., there is more loss with an incoherent source. This may be overcome by boosting source power where available. If power is limited, a more expensive coherent source may be used to advantage. A torpedo power source such as a battery can supply the energy for the preset commands memory and limited torpedo system testing for about six months. Launch power for the guidance and control, and engine start would be supplied by a thermal battery. All preset, launch commands and test communications are accomplished through the optic link. The torpedo system is commanded to go to a standby, low power state if no data transfer is occurring.

An advantage of this system is that it eliminates reliability problems with physical cable connections, allows fast, accurate presetting of the weapon, easier loading of torpedo in the launcher, and limited testing of torpedo systems.

What has thus been described is an optically based, high bandwidth, two-way communication link between a ships fire control system and a torpedo guidance and control system comprising at least one transmit channel/return channel pair, each channel having an electrical signal controlled light source which produces a proportional light beam. The beam is transmitted via an optical fiber through a pressure wall and permitted to propagate across a short seawater path where it illuminates a second optical fiber. From there it is transmitted by the second fiber to a photosensitive receiver which converts the light beam back to a corresponding electrical signal.

Obviously many modifications and variations of the present invention may become apparent in light of the above teachings. For example, the light source may be coherent such as a laser or incoherent; the hull penetrators which pressure seal the optical fibers may be any of the commercially available types; the longitudinal position of the fiber pair relative to the torpedo hull shape is optional; the number of channel pairs may be varied as desired; and the water gap location relative to the torpedo longitudinal axis may be selected to suit present weapon/tube configurations.

In light of the above, it is therefore understood that within the scope of the appended claims, the invention may be practiced otherwise than as specifically described.

What is claimed is:

1. A system for providing high bandwidth communications between a ship fire control system and a guidance and control system of a torpedo loaded in a launch tube, the cavity therebetween being flooded with sea water, comprising:

at least transmit channel, connected to said ship and to said torpedo, for transmitting data from said ship to said torpedo, said at least one transmit channel further comprising, a first light source means, located aboard said ship, for producing a first light beam modulated in proportion to an electrical signal from said ship fire control system, a first optical transmit fiber, attached to said first light source and to said launch tube, for receiving and transmitting said first light beam across said cavity through said sea water, a first optical receive fiber, attached to the hull of said torpedo, for receiving said first freely propagating light beam incident upon said first receive fiber and transmitting said first beam, and a first photosensitive receiver means, connected to said first receive fiber, for receiving said first beam from said first receive fiber, converting the modulated light signal to a proportional electrical signal and transmitting said electrical signal to said torpedo guidance and control system; and at least one receive channel, connected to said ship and to said torpedo, for transmitting return data from said torpedo to said ship.

2. A system according to claim 1 wherein said at least one receive channel further comprises:

a second light source means, located aboard said torpedo, for producing a second light beam modulated in proportion to an electrical signal from said torpedo;

a second optical transmit fiber, attached to said second light source and to said torpedo, for receiving and transmitting said second light beam across said cavity through said sea water;

a second optical receive fiber, attached to said launch tube, for receiving said second freely propagating light beam incident upon said second receive fiber and transmitting said second beam; and a second photosensitive receiver means, connected to said second receiver fiber, for receiving said second beam from said second receiver fiber, converting the modulated light signal to a proportional electrical signal and transmitting said electrical signal to said ship fire control system.

3. A system according to claim 2 further comprising an optically transparent window sealably attached to the pressure hull of said torpedo, said window being positioned so as to be in contact with said first receive fiber and said second transmit fiber, and having the exterior surface thereof shaped to match the contour of said hull.

* * * * *